US005484492A

United States Patent [19]

Rogers et al.

[11] Patent Number: 5,484,492

[45] **Date of Patent: * Jan. 16, 1996**

[54] AL-SI ALLOYS AND METHOD OF CASTING

[75] Inventors: Kevin P. Rogers, Ringwood, Australia; Christian Simensen, Oslo, Norway

[73] Assignee: Comalco Aluminum Limited, Melbourne, Australia

[ * ] Notice: The portion of the term of this patent subsequent to Jun. 8, 2010, has been disclaimed.

[21] Appl. No.: 272,509

[22] Filed: Jul. 7, 1994

Related U.S. Application Data

[63] Continuation of Ser. No. 852,178, Apr. 3, 1992, abandoned.

[30] Foreign Application Priority Data

Aug. 9, 1989 [AU] Australia ..... PJ5698

[51] Int. Cl.[6] ..... C22C 21/00

[52] U.S. Cl. ..... 148/437; 148/549; 148/417; 148/418; 148/439; 420/534; 420/535; 420/544; 420/549

[58] Field of Search ..... 148/549, 417, 148/418, 437, 439; 420/534, 535, 544, 549

[56] References Cited

U.S. PATENT DOCUMENTS

| | | | |
|---|---|---|---|
| 4,068,645 | 1/1978 | Jenkinson | 148/404 |
| 4,434,014 | 2/1984 | Smith | 148/417 |

FOREIGN PATENT DOCUMENTS

| | | |
|---|---|---|
| 186630/75 | 11/1975 | Australia . |
| 14535/76 | 6/1976 | Australia . |
| 75005/81 | 9/1981 | Australia . |
| 25538/88 | 5/1989 | Australia . |
| 30697/89 | 8/1989 | Australia . |
| 0170963 | 2/1986 | European Pat. Off. . |
| 1932537 | 2/1970 | Germany . |

OTHER PUBLICATIONS

Chemical and Physical Characteristics of Molten Aluminum, Chapter 3, Aluminum Casting Technology, American Foundryman's Society Inc., 1986, pp. 28–30.

ASM Metals Handbook, vol., 15, Castings, 9th Edition, 1988, pp. 164, 751–752.

P. Davami, et al, Strontium as a Modifying Agent for Al–Si Eutectic Alloy, British Foundryman, 72(4), 1979, pp. 4–7.

B. Closset, et al., A356.0 Alloys Modified with Pure Strontium, AFS Transactions, 1982, pp. 453–464.

J. E. Gruzleski, et al., Strontium Addition to Al–Si Alloy Melts, Proceedings of Conference on Solidification Processing, Sheffield University, 1987, pp. 52–54.

*Primary Examiner*—David A. Simmons
*Assistant Examiner*—Robert R. Koehler
*Attorney, Agent, or Firm*—Larson and Taylor

[57] ABSTRACT

A cast hypereutectic Al-Si alloy having 12% to 15% Si, and a method of producing such alloy. The alloy and a melt used in the method has at least one element of a first group of elements and at least one element of a second group of elements and further comprises Cu 1.5 to 5.5%; Ni 1.0 to 3.0%; Mg 0.1 to 1.0%; Fe 0.1 to 1.0%; Mn 0.1 to 0.8%; Zr 0.01 to 0.1; Zn 0 to 3.0%; Sn 0 to 0.2%; Pb 0 to 0.2%; Cr 0 to 0.1; Si modifier (Na, Sr) 0.001 to 0.1%; B (elemental) 0.05% maximum; Ca 0.03% maximum; P 0.05% maximum; and others 0.05% maximum each, the balance, apart from incidental impurities being Al. The element of the first group provides stable nucleant particles in the melt. The element of the second groups forms an intermetallic phase such that crystals of the phase form in advance of and nucleate primary Si to provide complex particles which promote nucleation of Al-Si eutectic on cooling of the melt below the eutectic solidification temperature. The level of each of the elements of the first and second groups is such that, on solidification of the melt, the casting has a microstructure in which any primary Si present is substantially uniformly dispersed, and in which the microstructure predominantly comprises a eutectic matrix. The element of the first group is not solely Ti where the element of the second group is solely Sr.

26 Claims, 5 Drawing Sheets

STAGE 1

Ti $B_2$-cluster in Al

STAGE 2

Al-Si-Z growth

AL-SI ALLOYS AND METHOD OF CASTING

This application is a continuation of application Ser. No. 07/852,178 filed Apr. 3, 1992, now abandoned.

This invention relates to Al-Si alloys, and to a method of casting such alloys with an improvement in castability.

On the basis of recent extensive research, we have developed a high strength, wear resistant Al-Si hypereutectic cast alloy (hereinafter referred to as "M3HA alloy") having additions of abnormally high levels of Sr, compared with those conventionally used, in combination with Ti. That alloy is the subject of our co-pending U.S. patent application Ser. No. 07/887,395, now U.S. Pat. No. 5,217,546, the full disclosure of which is hereby incorporated herein by reference as part of the present disclosure. While not yet commercially released, M3HA alloy has potential for wide ranging utility. We also have proposed an improved method of producing a casting, based on the use of M3HA alloy. In broad detail, M3HA alloy, which also exhibits good machinability, improved fatigue strength and good levels of ambient and elevated temperature properties, contains from 12 to 15% Si and Sr in excess of 0.10% together with Ti in excess of 0.005%, and further comprises:

| | | | |
|---|---|---|---|
| Cu | 1.5 to 5.5% | Pb | 0 to 0.2% |
| Ni | 1.0 to 3.0% | Cr | 0 to 0.1% |
| Mg | 0.1 to 1.0% | Na | 0 to 0.1% |
| Fe | 0.1 to 1.0% | B (elemental) | 0.05% maximum |
| Mn | 0.1 to 0.8% | Ca | 0.003% maximum |
| Zr | 0.01 to 0.1% | P | 0.003% maximum |
| Zn | 0 to 3.0% | Others | 0.05% maximum each, |
| Sn | 0 to 0.2% | | |

the balance, apart from incidental impurities, being Al and all percentages therein (and hereinafter) being by weight. The level of Sr in excess of 0.10% and Ti in excess of 0.005% is such that M3HA alloy has a microstructure in which any primary Si present is substantially uniformly dispersed and is substantially free of segregation, and in which substantially uniformly dispersed Sr intermetallic particles are present but are substantially free of such particles in the form of platelets. The microstructure of M3HA alloy predominantly comprises a eutectic matrix.

The present invention arises out of ongoing research into M3HA alloy in relation to its characteristics detailed in the immediately preceding paragraph herein. In this, we also have considered characteristics of alloys based on M3HA but having a conventional level of Sr and/or Ti. The research has been directed to gaining an understanding of the unexpected beneficial results achievable with the use of the indicated abnormally high levels of Sr in combination with Ti. However, in addition to providing such understanding, our ongoing research has led to the discovery of further alloys which, while not necessitating the use of Sr at higher than normal levels in combination with Ti, are comparable in some important respects to M3HA alloy.

In M3HA alloy, the level of Sr is such that, while it does not eliminate the presence of primary Si particles in complex castings, it instead substantially prevents those primary Si particles that do form from floating. This unexpected result is increased by the presence of Ti which, surprisingly, also suppresses the formation of primary Si particles in the presence of the high levels of Sr. As a consequence, M3HA alloy can be substantially free of primary Si particles, while flotation of primary Si particles as do form is substantially suppressed to achieve a microstructure in which the Si particles are substantially uniformly dispersed and are substantially free of segregation. Additionally, the Ti has a second beneficial effect of preventing formation of detrimental Sr intermetallic particles in the form of platelets; such particles being present, but in a substantially equiaxed, blocky form.

We now have found that, in relation to the suppression of primary Si particles, the solidification of M3HA alloy appears to proceed in accordance with a number of interrelated effects. While the effects are set out in the following and are consistent with experimental results to date, the effects are to be understood as being for the purposes of illustration, rather than as necessarily limiting. The effects are discussed in the following.

BACKGROUND TO THE EFFECTS

With an alloy of the same overall composition as M3HA, but having a conventional Sr level of less than 0.1%, primary Si particles form on or in the vicinity of the mould wall as the melt is poured. Subsequent incoming melt washes the particles into the body of the melt. If cooling of the melt is sufficiently slow, the primary Si particles grow and can become large in size. If, on the other hand, solidification of the melt is relatively rapid, growth of the particles is substantially avoided. In either case, the relatively low density primary Si particles tend to float, giving rise to segregation, with the adverse consequences of this being more severe with large particles.

In the case of M3HA alloy, Sr combines with Al and Si in the melt to form intermetallic particles of an Al-Si-Sr phase. It is these particles rather than primary Si, which form on or in the vicinity of the mould wall at the start of melt pouring and are then swept into the body of the melt. The formation of the Al-Si-Sr phase changes the conditions at the mould walls in that it allows the mould to heat up before the formation temperature for primary Si is reached. As a result, Si formation at the mould walls is suppressed. In the absence of Ti in M3HA, the Sr intermetallic particles form predominantly as undesirable platelets. However when Ti is present, these Al-Si-Sr intermetallic particles form as equi-axed particles, except when the solidification rate is very high, in which case the particles can form as platelets.

Effect I

Under this heading, we are bracketing a series of effects since, to a substantial degree, these are found to be interrelated and sequential. This series of effects is detailed in the following discussion as essentially sequential Stages 1 to 5.

Stage 1:

While a melt of M3HA alloy is at a relatively high temperature, such as about 700°–750° C., small particles typically about 1 μm or less are present. The particles have relatively low solubility in molten Al and are added nucleant particles. The added nucleant particles present in the M3HA alloy may be particles of at least one of (Al, Ti)$B_2$, $TiB_2$, $TiAl_3$, TiC and TiN which nucleate phases that form during solidification of the alloy.

Stage 2

This stage involves initial cooling of the M3HA melt to a temperature below that of Stage 1, such as to about 600° C. During this initial cooling an Al-Si-Sr phase, typically $Al_2Si_2Sr$, is nucleated on the particles present in Stage 1 or on the mould walls.

Stage 3

This stage occurs on further cooling of the melt to the eutectic solidification temperature of about 560° C. During this stage, complex particles are produced by primary Si forming on the crystals of the Al-Si-Sr phase. By having plentiful nucleant particles in the melt in Stage 1, a high nucleation rate occurs so that the volume ratio of primary Si to Al-Si-Sr phase is minimized.

Stage 4

With cooling below about 560° C., heterogeneous nucleation of Al-Si eutectic occurs on the complex particles produced in Stage 3, or clusters of those particles, and on other surfaces such as mould walls. As is known, such heterogeneous nucleation is energetically favoured on surfaces with cracks, steps or other faults, and on surfaces which are easily wetted by the solidifying phase. The complex particles act as suitable nucleants for Al-Si eutectic although, for this role to be optimised, the complex particles preferably have an optimum particle size from 5 to 20 μm, most preferably from 10 to 20 μm.

Stage 5

As the temperature of the melt decreases further, multiple eutectic cells form, with the final cell size of the solidified casting of M3HA alloy being controlled by the number of Al-Si eutectic cells which nucleate. The greater the number of cells, the finer is their size.

Effect II

As indicated in Effect I, the Sr content of M3HA results in particles of an Al-Si-Sr intermetallic phase at a temperature above the primary Si formation termperature. Since the Al-Si-Sr particles form before primary Si, they are able to act as nuclei for primary Si. If the Al-Si-Sr particles are permitted to form predominantly as platelets, due to use of less than the required level of Ti, it is found that, while relatively few primary Si particles subsequently are formed, the Si particles tend to be relatively large in size. On the other hand, the required level of Ti in M3HA results in smaller, equiaxed Al-Si-Sr particles and fine primary Si particles. As indicated above, the primary Si is nucleated by the Al-Si-Sr particles. The Ti content of M3HA, in causing the Al-Si-Sr particles to be present in an equi-axed, rather than platelet form, results in many more of the intermetallic particles being present, thereby increasing the potential number of potential nucleation sites for primary Si. Also, with both the equiaxed and platelet forms of Al-Si-Sr particles, nucleation of primary Si occurs on clusters of the particles, and it appears that more suitable clusters form with the equiaxed particles than with the platelet particles. The equiaxed particles thus result in nucleation of many more primary particles than is possible with the platelet particles and, because of the higher nucleation rate, the growth of primary Si necessarily is low so that the primary Si particles remain relatively small.

Effect III

The many fine primary Si particles resulting from Effects I and II promote nucleation of eutectic as fine eutectic cells in advance of the solidification front of the cast melt. Thus the result of Effects I and II is that a zone in advance of the solidification front becomes mushy and possibly wider. As a result, the movement of eutectic cells is restricted and any free primary Si particles become physically entrapped in the zone associated with the solidification front, while their growth potential quickly is restricted by depletion of in their immediate vicinity. Without the influence of Effects I and II, the zone associated with the solidification front would be less mushy and narrower, so that the (more numerous) primary Si particles would be able to move more easily and hence to float and grow.

Central to the stages described in relation to Effect I is the nucleation of Al-Si-Sr phase in Stage 2 on suitable nucleant particles present in Stage 1. Also of importance is that the Al-Si-Sr phase so nucleated has a solidification temperature sufficiently in excess of the primary Si solidification temperature to enable formation of complex particles in Stage 3 of Si plus Al-Si-Sr. Also, the complex particles of Stage 3 are required to be of a form and size such that they enable nucleation of Al-Si eutectic in Stage 4.

We have found that simple or complex compounds other than those based on Ti should be capable of promoting the formation of Al-Si-Sr. We also have found that elements Z other than Sr, capable of forming a phase of the general form Al-Si-Z or Al-Z, can function similarly to Al-Si-Sr. Thus, certain elements X are able to be used as alternatives for Ti and certain elements Z are able to be used as alternatives for Sr. Also, use of these alternative elements has been found to be consistent with Effects I to III.

According to one aspect of the invention, there is provided a method of producing a casting of a hypereutectic Al-Si alloy having 12% to 15% Si, comprising:

(a) providing a melt of a composition suitable to form the alloy; and (b) casting the melt in a mould to form a casting of the alloy.

The suitable melt composition is one in which, in addition to 12% to 15% Si, there is provided each of at least one element X and at least one element Z at a level in excess of a predetermined respective level, the melt further comprising elements A as follows:

| | | | |
|---|---|---|---|
| Cu | 1.5 to 5.5% | Pb | 0 to 0.2% |
| Ni | 1.0 to 3.0% | Cr | 0 to 0.1% |
| Mg | 0.1 to 1.0% | Si modifier (Na, Sr) | 0.001 to 0.1% |
| Fe | 0.1 to 1.0% | B (elemental) | 0.05% maximum |
| Mn | 0.1 to 0.8% | Ca | 0.03% maximum |
| Zr | 0.01 to 0.1% | P | 0.05% maximum |
| Zn | 0 to 3.0% | Others | 0.05% maximum each |
| Sn | 0 to 0.2% | | |

the balance, apart from incidental impurities, being Al. The element X can be any element which provides stable nucleant particles in the melt; the particles having a melting point in excess of the solidification temperature of an intermetallic phase formed by the at least one element Z. The element Z can be any element which forms an intermetallic phase at a temperature in excess of the temperature of formation of primary Si. That intermetallic phase preferably is able to be nucleated, by sites on mould walls or by particles of compounds based on element X, to form crystals of the intermetallic phase. Moreover, the element Z is selected such that the crystals of the intermetallic phase enable nucleation of primary Si thereon to form complex particles. The complex particles formed by nucleation of primary Si then promote nucleation of Al-Si eutectic with cooling of the melt below the eutectic solidification temperature. The levels of elements X and Z in excess of the predetermined respective level for each is such that, on solidification of the melt, the casting has a microstructure in which any primary Si present is substantially uniformly dispersed, and in which the microstructure predominantly comprises a eutectic matrix.

The invention also provides a cast hypereutectic Al-Si alloy with from 12% to 15% Si, the alloy containing elements A, X and Z as specified in the preceding paragraph. The alloy has elements X and Z in excess of the predetermined respective level for each such that the alloy has a microstructure in which any primary Si present is substantially uniformly dispersed, with the microstructure predominantly comprising a eutectic matrix.

The intermetallic phase preferably is of the general form Al-Si-Z', where Z' is at least one element Z. However the intermetallic phase may be of a more general Al-Z' form, rather than one containing Si. In the case of Al-Si-Z'; the Al-Si-Z' phase may be a ternary phase, but, as more than one element Z can be present, the phase may be a quaternary or higher order phase. Similarly, the Al-Z' phase can be a binary, ternary, quaternary or higher order phase. However, in each case, the intermetallic phase is to be one which acts as a nucleant for primary Si and also is compatible with modification of eutectic Si. Indeed, on the latter point, while there is some similarity between the nucleation of primary Si in accordance with the invention and the refining of Si in other hypereutectic alloys, a key advantage with the invention is that it provides subsequent modification of the eutectic Si.

In the context of Effect I, in relation to M3HA having higher than normal levels of Sr in combination with Ti, there additionally may be benefit if the Al-Si-Sr phase has a density sufficiently above that of the melt, such that crystals of that phase do not float. Similarly, it may be beneficial if the density of complex particles produced by primary Si forming on the crystals of the Al-Si-Sr phase, also is such that the complex particles do not float. In the more general context of an intermetallic phase, such as an Al-Si-Z' or Al-Z' phase, it also may be desirable that the density of the intermetallic phase is to be such that the tendency for segregation, due to flotation or sinking, is substantially avoided. However, as discussed above in relation to Effect III, the selected elements X and Z are to facilitate refinement of Al-Si eutectic cells which give rise to a mushy melt in which the crystals of intermetallic phase and resultant complex particles, and any free primary Si particles, become entrapped such that their flotation or sinking is substantially prevented, notwithstanding their densities.

In the method and alloy according to the invention, element X provides nucleant particles having a melting point in excess of the formation temperature of the intermetallic phase, such as Al-Si-Z' or Al-Z' phase, as indicated above. The melting point may be substantially in excess of about 650° C., such as in excess of about 700° C. The lower level for the solidification point of the nucleant particles is dependent on the element Z which is selected, and on the solidification point of the crystals of the resultant Al-Si-Z' or Al-Z' phase that is formed. An excess of at least about 20° C. generally is desirable.

The element X may include at least one of Cr, Mo, Nb, Ta, Ti, Zr, V, Al and mixtures thereof, provided that element X is not solely Ti where element Z is solely Sr. The element X can be added as a compound, such as in a master alloy composition, which yields stable nucleating particles of the respective carbide, boride, nitride, aluminide, phosphide or mixtures thereof. However, of the borides, Al B is undesirable because of its tendency to react with Sr in the melt, with adverse consequences for eutectic modification.

In the case of element X used as the phosphide, it is to be appreciated that addition of phosphide other than as the Al compound in general will result in the Al phosphide compound being formed. It therefore is preferred that an element X other than Al be added only in so far as the level of that element X, in elemental form, is consistent with overall limits for that form. Also, it is to be appreciated that Al phosphide can be formed by addition of a phosphide of an element A or even an element Z, again in so far as this is consistent with overall limits for that element A or Z in elemental form.

In the method of producing a casting according to the invention, the element X has an important role in providing nucleant particles, such as of the boride, aluminide, carbide, nitride, phosphide or mixtures thereof, of the element X. This role is detailed in relation to Effect I with reference to Ti as element X.

As indicated above, the element Z is required to provide an intermetallic phase, such as of the type Al-Si-Z' or Al-Z', which forms at a temperature above the formation temperature of primary Si. Also, with cooling of the melt to about 560° C., the Al-Si-Z' or Al-Z' phase is to be such that it nucleates primary Si to provide complex particles which preferably are wetted by, and enable nucleation of, Al-Si eutectic on cooling of the melt below about 560° C. Not all elements are suitable for this purpose. The most highly preferred examples of element Z include Ca, Co, Cr, Fe, Mn and Sr, and mixtures thereof, provided that element Z is not solely Sr where element X is solely Ti. Other, less highly preferred examples of element Z include Cs, K, Li, Na, Rb, Sb and elements from the Lanthanide and Actinide series, and mixtures thereof and mixtures with the more highly preferred examples. However, the elements of the Lanthanide and Actinide series generally are precluded by cost, rarity and in some cases by radioactivity. Also, use of Li presents the usual problem of recourse to operation under vacuum.

The above indicated examples of element Z include Ca, Cr, Fe, and Mn which also are present as elements A, or Na which can be present as Si modifier in place of Sr. Also, the examples of element Z include Sr which may be an element A present as Si modifier instead of Na. Where Ca, Cr, Fe, Mn or Na is present as element Z, the predetermined level thereof is in excess of the respective upper limit, as element A, of 0.03% for Ca 0.1% for Cr, 1.0% in the case of Fe, 0.8% in the case of Mn and 0.01% for Na. Also, in relation to Sr as element Z, it is to be understood that the Si modifier included as one of the elements A may, for example comprise Na, but most conveniently comprises Sr to a level of up to 0.1%. Where Sr is present as Si modifier and also is present as element Z, the predetermined level of Sr is in excess of 0.1%.

Cr is an example of a metal able to be used as both element X and element Z, and these dual roles can be provided simultaneously. This is possible because, as with other elements X, Cr provides nucleant particles when present at a relatively low level, with an excess of a higher level being required for its function as element Z. As element X, Cr most preferably is present as carbide, boride, nitride, aluminide or a mixture thereof, such compound form further distinguishing between X and Z functions due to Cr being in its elemental form for the Z function.

Zr, which is present as an element A, also may be present as an element X. Where Zr is present as an element X, it is at a level in excess of the upper level of 0.1% for its functioning as an element A. Also, Zr is present in elemental form as element A, but as a compound, most preferably as a carbide, boride, nitride, aluminide or a mixture thereof, when present as element X.

Table I provides detail in relation to representative examples of elements Z.

TABLE I

| Intermetallic Phases | | | |
|---|---|---|---|
| Element Z | Phase | Typical Addition of Z(wt. %) to form Al—Z/Al—Si—Z Phase | Approximate Formation T (°C.) for Phase |
| Ca | $Al_2Si_2Ca$ | 1.0 | 637 |
| Co | $Co_2Al_9$ | 1.5 | 670 |
| Cr | $Cr_4Si_4Al_{13}$ | 0.7 | 635 |
| Fe | $FeSiAl_5(\beta)$ | 1.6 | 620 |
| Mn | $Al_{15}Mn_3Si_2(\alpha)$ | 1.2 | 645 |
| Na | $NaAlSi_2$ | 0.3 | 690 |
| Sb | $SbAl_9$ | 1.0 | 660 |
| Sr | $Al_2Si_2Sr$ | 0.3 | 680 |

Experiments have been conducted, using Cr as element Z, to verify the influence of Effect I established on the use of Sr as such element, as a means of controlling the solidification and structure of castings. In preparing alloys for the experiments, intermediate alloys were prepared and melted, and subsequently held in an electric pit furnace. Cr was then added (as Al-10%Cr) to provide varying concentrations from 0.1 to 0.7% Cr (in 0.2% increments). When the Cr was completely dissolved, part of each melt was cast into a sand mould (40 mm×80 mm diameter) at 750° C. Following this, an addition of Ti (as Al5TilB) was made to the remaining melts to achieve a Ti level of 0.02%, predominantly as $TiB_2$, and further castings were poured at 750° C. All castings were sectioned and examined for primary Si flotation and primary Si size.

The compositions of the melts were as follows:

| | | | |
|---|---|---|---|
| Si | 13.7% | Zr | 0.04% |
| Cu | 1.8% | Zn | 0.02% |
| Ni | 1.7% | Sr | 0.05% (Si modifier) |
| Mg | 0.48% | Ti | <0.005% or at 0.02% |
| Fe | 0.25% | B | less than 0.05% |
| Mn | 0.35% | Cr | 0.1%, 0.3%, 0.5%, 0.7% |

the balance, apart from incidental impurities, being Al. In these compositions, Sr at 0.05% provided Si modification, but was insufficient for Sr to function as an element Z. Also, Ti at the level of less than 0.005% was insufficient for Ti to function as an element X.

The results are summarized in Table II, in which "3HA" designates the alloy content apart from its Cr content in compositions (a) to (d), having <0.005% Ti; while "3HA" designates the alloy apart from its Cr and Ti content in compositions (e) to (h). Table II shows that the level of primary Si flotation decreased with increasing Cr content and the increasing influence of Ti on primary Si particle sizes. As predicted, at Cr levels above 0.5%, primary Si flotation was eliminated. At Cr contents above 0.5%, an intermetallic rich in Cr (most likely $Cr_4Si_4Al_{13}$) was evident throughout the section.

TABLE II

| The Effect of Increased Additions of (a) Cr and (b) Cr + Ti(Al5TilB) | | |
|---|---|---|
| Composition | Primary Si Flotation | Primary Si Concentration |
| a) 3HA + 0.1% Cr | High | Many small particles (50–100 μm) |
| b) 3HA + 0.3% Cr | Medium | Many small particles (50–100 μm) |
| c) 3HA + 0.5% Cr | Low | Few large particles (300–400 μm) |
| d) 3HA + 0.7% Cr | Negligible | Few large particles (300–400 μm) |
| e) 3HA + 0.1% Cr + 0.02% Ti | High | Many small particles (50–100 μm) |
| f) 3HA + 0.3% Cr + 0.02% Ti | Medium | Many small particles (50–100 μm) |
| g) 3HA + 0.5% Cr + 0.02% Ti | Low | Few medium particles (100–200 μm) |
| h) 3HA + 0.7% Cr + 0.02% Ti | Negligible | Few small particles (50–100 μm) |

The effect of the Cr addition is similar to that of Sr where the latter is present at a level in excess of 0.1%, in that it prevents the flotation or other segregation of primary Si. While the size of the primary Si can increase from 200 μm to 500 μm, this latter effect is minimized by the addition of 0.02% Ti, the primary Si decreasing in size to less than 200 μm and the number per unit volume increasing.

Further experiments were conducted using Mn, or Mn and Cr in combination, as element Z. In the case of Mn as element Z, we cast alloys of the following compositions:

| | | | |
|---|---|---|---|
| Si | 13.8% | Zr | 0.03% |
| Cu | 1.75% | Zn | 0.02% |
| Ni | 1.68% | Sr | 0.04% (Si modifier) |
| Mg | 0.52% | Ti | <0.005% or at 0.02% |
| Fe | 0.23% | B | less than 0.05% |
| Mn | 1.7% | Cr | <0.02% |

the balance, apart from incidental impurities, being Al. The results, summarized in Table III (in which "3HA" has the same respective relevance as in Table II), show that Mn alone as element Z behaves very similarly to both Sr and Cr.

TABLE III

| The Effect of Increased Additions of (a) Mn and (b) Mn + Ti (Al5TilB) | | |
|---|---|---|
| Composition | Primary Si Flotation | Primary Si Concentration |
| i) 3HA + 1.7% Mn | Negligible | Few large particles (300–400 μm) |
| j) 3HA + 1.7% Mn + 0.02% Ti | Negligible | Few small particles (50–100 μm) |

In the case of Mn and Cr in combination as element Z, the procedure was the same except that the alloy compositions were as follows:

| | | | |
|---|---|---|---|
| Si | 13.8% | Zr | 0.04% |
| Cu | 2.0% | Zn | <0.01% |
| Ni | 1.8% | Sr | 0.04% (Si modifier) |
| Mg | 0.53% | Ti | <0.0005% or at 0.02% |
| Fe | 0.15% | B | less than 0.05% |
| Mn | 0.57% | Cr | 0.20% |

the balance, apart from incidental impurities, being Al. The results with these alloy compositions, based on use of Mn and Cr in combination, were essentially the same as detailed in Table III for use of Mn alone.

Further experiments illustrate Effects II and III. In these, three sample melts were prepared of each of five differing alloys AtoE. Each alloy had:

| | | | |
|---|---|---|---|
| Si | 13.6% | Fe | 0.20% |
| Cu | 1.8% | Mn | 0.30% |
| Ni | 1.9% | Zr | 0.04% |
| Mg | 0.6% | Zn | 0.05% |

but differed as follows:

| Alloy | Sr | Ti | Cr | Mn |
|---|---|---|---|---|
| A | 0.04% | — | — | — |
| B | 0.3% | — | — | — |
| C | 0.3% | 0.02% | — | — |
| D | 0.04% | — | 0.2% | 0.6% |
| E | 0.04% | 0.02% | 0.2% | 0.6% |

The balance of each alloy, apart from incidental impurities, was Al, with the Ti addition in alloys C and E being as Al5TilB. For each alloy, the samples were heated in a furnace in a clay crucible to attain a melt temperature of 750° C. On reaching equilibrium at that temperature, a respective sample of each alloy then was:

(i) carefully removed from the furnace and allowed to solidify under quiescent conditions in the crucible in which it had been heated;

(ii) removed from the furnace, poured at about 750° C. from the crucible in which it had been heated, into a similar crucible at ambient temperature, and allowed to solidify; and (iii) solidified as in (ii) except that the similar crucible had been preheated to 450° C.

The respective solidified samples were sectioned, and their microstructures were examined. The results are summarised in Table IV.

TABLE IV

| | Casting Evaluation Tests* | | |
|---|---|---|---|
| Alloy | Condition (i) Quiescent Solidification | Condition (ii) Cold Mould Turbulent Fill | Condition (iii) Hot Mould Turbulent Fill |
| A | NF Si (150–200μ) | F Si (100–200μ) | F Si (150–200μ) |
| B | F + NF Si (250–300μ) | NF Si (250–300μ) | NF Si (250–300μ) |
| C | F + NF Si (100–200μ) | NF Si (100–200μ) | NF Si (100–200μ) |
| D | F + NF Si (250–300μ) | NF Si (250–300μ) | NF Si (250–300μ) |
| E | F + NF Si (150–250μ) | NF Si (150–250μ) | NF Si (150–250μ) |

*"F Si" designates primary Si particles, of the average size indicated, which exhibited flotation; while "NF Si" similarly designates such particles for which negligible flotation was apparent.

Condition (i) of course represents an ideal, rather than practical foundry operation. However, when compared with conditions (ii) and (iii), it makes clear the influence of an inevitable degree of disturbance of the solidification front caused by turbulence from pouring of a melt of the alloys. With alloy A under condition (i), primary Si particles were substantially absent, with the few that did form being associated with nucleation sites at the mould wall. With alloys B to E under condition (i), some floated Si particles were present as would be expected from effect I, since the Sr or Cr+Mn form intermetallic particles providing nucleants for the Si. That is, under the very slow solidification of condition (i), some Si particles were able to segregate by flotation.

Under conditions (ii) and (iii), alloy A exhibited flotation of primary Si, attributable to nucleation of primary Si occurring at the mould wall with the Si particles then being swept into the melt before solidification. However, for each of alloys B, C, D and E, having at least one element Z according to the invention, flotation of primary Si was substantially prevented. Also, alloys C and E (having an element X according to the invention, represented by Ti), exhibited a reduction in the average size of primary Si particles when compared with alloys B and D (which did not have an element X beyond residual levels).

Effects I to III detailed above are believed to explain the mechanisms by which additions of elements such as Sr/Ti reduce the level of primary Si segregation by flotation and control the size of primary Si and grains in castings of M3HA alloy. Cr and Mn, two of the alternatives to Sr, have been tested and the results show that each of Cr and Mn is as effective as Sr in controlling primary Si segregation and growth. The addition of Ti causes the primary Si particles to decrease in size to less than about 200 μm and their number to increase per unit volume. Provided an element Z or a combination of elements Z is present, it is believed to be easier to produce 3HA castings which exhibit good microstructure. As indicated above, alternatives to Cr, Mn and Sr include Ca, Co, Cs, Fe, K, Li, Na, Rb, Sb, Y, Ce, and Lanthanide and Actinide series elements; while alternatives to Ti include Cr, Mo, Nb, Ta, Zr and V.

The method of the invention enables optimum properties to be achieved in the castings which have microstructures predominantly comprising a eutectic matrix. Specifically, the alloy exhibits excellent wear resistance and machinability, and also good fatigue resistance and ambient and elevated temperature tensile properties. However, the method also provides such alloys having improved castability. That is, castings can be made in sand, ceramic and permanent moulds, and combinations thereof, including such moulds of complex form and with varying wall thicknesses. The nature and method of filling of the moulds generally is of little consequence, and it is to be understood that the invention is not limited to the use of particular moulds. Castings can be made in gravity fed permanent moulds, as well as in low, medium and high-pressure fed die casting moulds, and in mould arrangements for squeeze casting.

The alloy to which the invention is directed has a hypereutectic Al-Si microstructure. Accordingly, the lower limit of its Si content is 12% as alloy compositions with less than 12 wt. % Si are hypoeutectic. Also, the upper limit of Si should not exceed about 15%, as control over the formation of primary Si formation cannot be achieved solely by chemical means at higher than about 15% Si. That is, with Si in excess of about 15%, it is necessary to have recourse to closely controlled solidification techniques, such as directional solidification, in order to control primary Si formation.

Of the elements A, the additions of Cu, Ni, Mg, Fe, Mn and Zr are added to provide strengthening and hardening intermetallic compounds. In general, it is necessary that each of these elements be present at or in excess of the respective lower limits specified above in order to achieve formation of such compounds at a level providing practical benefits in terms of strengthening and hardening. However, when present in excess of the above-mentioned upper limits, Cu, Ni, Mg, Fe, Mn and Zr, as elements A, either do not achieve any further beneficial effect in forming such intermetallic particles, or they can have adverse consequences for properties of the alloy.

As elements A, the alloy of the invention can include Zn, Sn, Pb and Cr. These elements, in general, do not confer a significant beneficial effect. They also do not have adverse consequences when used at or below the respective upper limits specified above. However, if present, they should not exceed those limits to avoid adverse consequences. While Zn, Sn, Pb and Cr, as elements A, do not achieve a significant beneficial effect, it is necessary that they be taken into account. The principal reason for this is that those elements can be present and, typically, one or more of them will be present, where the alloy used in the invention is a secondary alloy produced from or including scrap material.

Other elements can be present as element A, but at a level not exceeding 0.05% each. In M3HA alloy, as disclosed at the outset, the upper limit of 0.003% is indicated for each of Ca and P. However, with the alternatives for Sr, Ti or each of Sr and Ti, that limit can be increased to 0.03% for Ca and 0.05% for P.

Included in the elements A is Si modifier, which may be Na or Sr. Where the modifier is Na, the level of Na is from 0.001% to 0.01%. Below 0.001% Na does not achieve a sufficient level of eutectic modification. Above 0.01%, Na has been thought to have the adverse consequence of over-modification, but we now have found that this is not the case where Na is present as an element Z at a level in excess of 0.2%. Thus, Na when present in excess of such level is found to operate in accordance with Effects I to III due to a fine eutectic matrix being achieved and offsetting that tendency. Where the modifier is Sr, the corresponding levels for eutectic modification are 0.01% to 0.1% for effective eutectic modification. In excess of 0.1% Sr does not achieve further beneficial effects in terms of modification of the eutectic Si. However, at a level in excess of 0.1%, Sr can be used as an element Z as detailed above and in the following.

As indicated, the element X can comprise one or a combination of possible elements selected from Cr, Mo, Nb, Ta, Ti, Zr, V and Al. Each of these elements has in common the ability to form nucleants in which they are present for example as a boride, carbide, nitride, aluminide, phosphide or a mixture thereof.

Where Ti alone is used as the element X, it is present at a level in excess of 0.005% since, below 0.005%, Ti does not achieve any beneficial effect in the first role. When Ti is added as Al-Ti-B master alloy, the level of Ti as element X preferably should not exceed 0.1% since, above this level, it has a negative consequence and appears to increase primary Si formation. When Ti as element X is added in forms other than as Al-Ti-B master alloy, the optimum level can be different but, in general, as for example with $TiAl_3$ as in Al-Ti master alloy, the Ti level preferably should not exceed 0.25%. The level of Ti required as element X is dictated in part by, and generally increases with, the level of element Z in excess of its lower limit. Preferably Ti as element X is provided at a level of from 0.01% to 0.06%, most preferably from 0.02% to 0.06%, such as from 0.03 to 0.05%.

Each other alternative for element X, considered separately, varies somewhat similarly to Ti. Thus, the lower limit to achieve a beneficial effect is 0.005%. However, in the case of Cr, Mo, Nb, Ta, Zr, V and Al, little if any beneficial effect is achieved beyond 0.25%, and the level most preferably does not exceed 0.2%. Except where the addition is as a boride, for which a preferred upper limit is 0.1%, a preferred range for each as element X is 0.01% to 0.2%, with most preferred ranges being:

| | | | |
|---|---|---|---|
| Cr | 0.02 to 0.10% | Zr | 0.05 to 0.10% |
| Mo | 0.02 to 0.10% | V | 0.05 to 0.15% |
| Nb | 0.02 to 0.15% | Al | 0.01 to 0.15% |
| Ta | 0.02 to 0.10% | | |

These alternatives of element X and also Ti can be used in a combination of two or more, with each in general being able to be substituted for another on a substantially equal wt. % basis. Most preferably the element X is added in a form providing particles thereof comprising the respective carbide, boride, nitride, aluminide, phosphide or a mixture thereof. However, the wt. % specified above is calculated as the elemental form of the element X.

The element Z can comprise at least one of Ca, Co, Cr, Cs, Fe, K, Li, Mn, Na, Rb, Sr, Y, Ce and other rare earth metals. Where Sr is used alone, it is necessary that it be present at a level in excess of 0.10%, such as from 0.11% to 0.4%. Most preferably, Sr is present at from 0.18% to 0.4%, such as from 0.25% to 0.35%. Below 0.10%, Sr does not achieve a beneficial effect other than modification of eutectic Si, while in excess of 0.4% Sr does not provide a further beneficial effect and can result in excessive intermetallic particles. In general, Cs, K, Li and Rb, as elements Z, necessitate a level of addition essentially as for Sr.

The lower and upper limits for other alternatives for element Z vary somewhat with the particular element chosen. However, the lower and upper limits, for attainment of a beneficial effect, are:

| | | | |
|---|---|---|---|
| Ca | 0.9% to 2.0% | Na | 0.1% to 0.4% |
| Co | 0.5% to 3.0% | Sb | 0.5% to 2.0% |
| Cr | 0.5% to 1.0% | Y | 0.5% to 3.0% |
| Fe | 1.5% to 2.0% | Ce | 0.5% to 3.0% |
| Mn | 1.0% to 2.0% | Others | 0.5% to 3.0% |

Beneficial effects are not achieved above these upper limits. The preferred ranges for these elements are:

| | | | |
|---|---|---|---|
| Ca | 0.9% to 1.2% | Na | 0.2% to 0.4% |
| Co | 0.5% to 2.5% | Sb | 0.5% to 1.5% |
| Cr | 0.5% to 0.8% | Y | 0.5% to 2.5% |
| Fe | 1.5% to 1.75% | Ce | 0.5% to 2.5% |
| Mn | 1.0% to 1.25% | Others | 0.5% to 2.5% |

While an upper limit of 0.03% is indicated above for Ca, this applies where Ca is present as an element A. The limit is to avoid adverse consequence which higher levels of Ca can have for the fluidity of the melt. However, as indicated, Ca can be present as an element Z at from 0.9 to 2.0%, preferably 0.9 to 1.2%, and this is found to be possible because that adverse consequence is offset by Ca forming intermetallic particles of Al-Si-Z phase (typically $Al_2Si_2Ca$) in Stage 2, with primary forming on these particles in Stage 3.

BRIEF DESCRIPTION OF THE DRAWING

In order to illustrate the invention further, reference is made to the accompanying drawings, in which:

As illustrated in FIG. 1, stable nucleant particles of element X are present in the melt at high temperatures of about 700°–750° C. The particles, typically about 1 μm in size, comprise or include carbide, boride, nitride, aluminide, phosphide or a combination such compounds of at least one element X, having low solubility in molten Al. FIG. 1 depicts particles as typical of $TiB_2$ forming a cluster in the melt.

Stage 2 occurs on cooling of the melt down to approximately 600° C. During this stage, the phase Al-Si-Z' nucleates on the nucleant particles containing element X, as depicted in FIG. 2.

Figure 3:
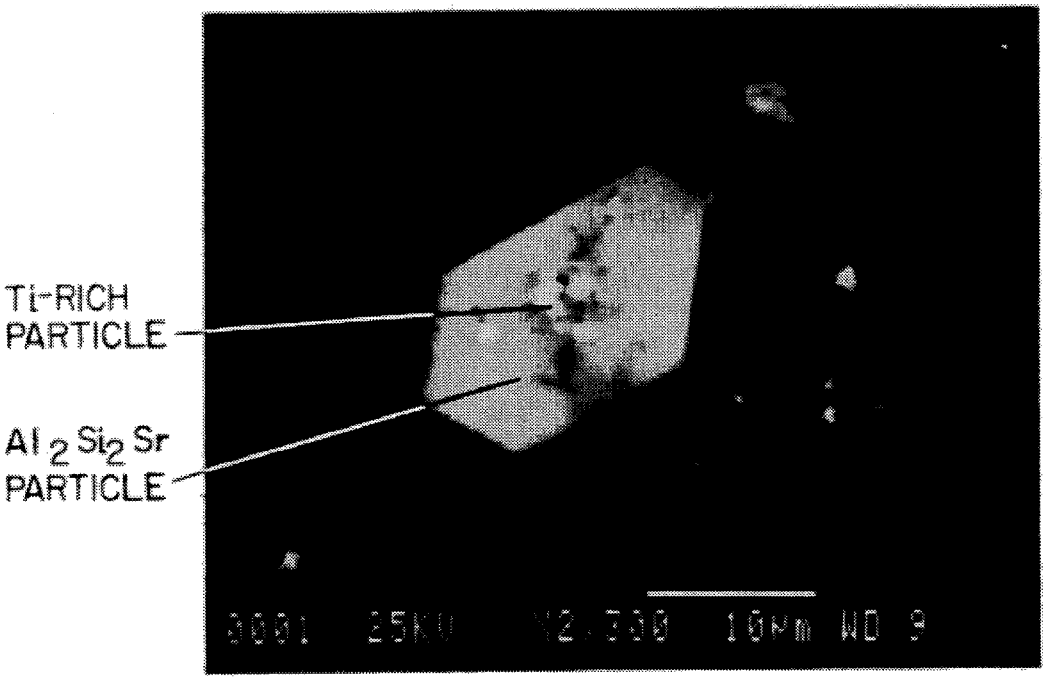
FIG. 3 is a photomicrograph illustrating Stage 2 under Effect I.

The photomicrograph (X2300) of FIG. 3, shows $Al_2Si_2Sr$ phase nucleated on a cluster of Ti-rich particles believed to be $TiB_2$. Similar nucleation of Al-Si-Z' phase occurs with other elements Z as herein specified, whether X is Ti or as otherwise detailed herein.

Figure 1:
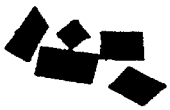
FIGS. 1 and 2 are schematic representations of the process of the invention in Stages 1 and 2 under Effect I.
Figure 2:
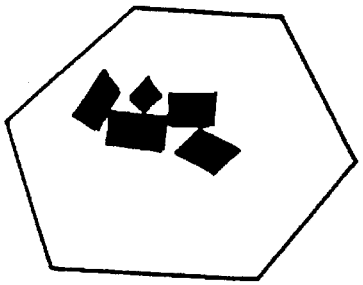
Figure 4:
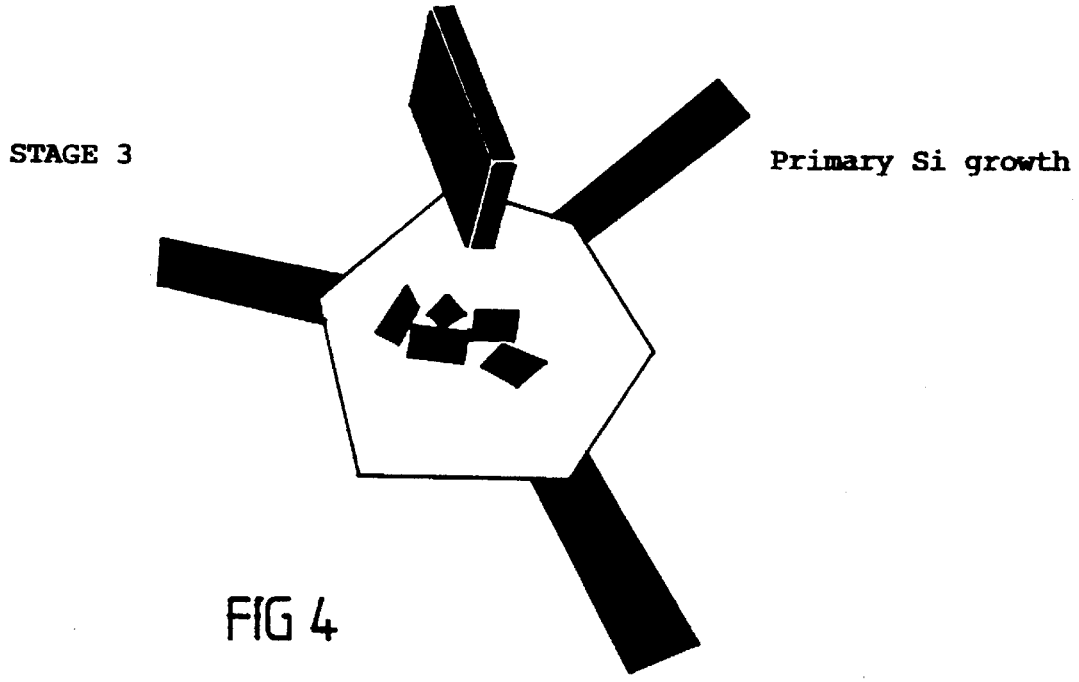
FIG. 4 is a schematic representation of the process in Stage 3 under Effect I.

FIG. 4 illustrates formation of primary Si on the Al-Si-Z' of the composite particle of FIG. 2, as the melt is further cooled in Stage 3 from 600° C. down to the eutectic solidification temperature of about 560° C. The primary Si typically forms at a number of sites on the Al-Si-Z' phase, producing complex particles, while the initial plentiful nucleant particles in the melt provides a high nucleation rate for Si so that the volume ratio of primary Si to Al-Si-Z' is minimized.

Figure 5:
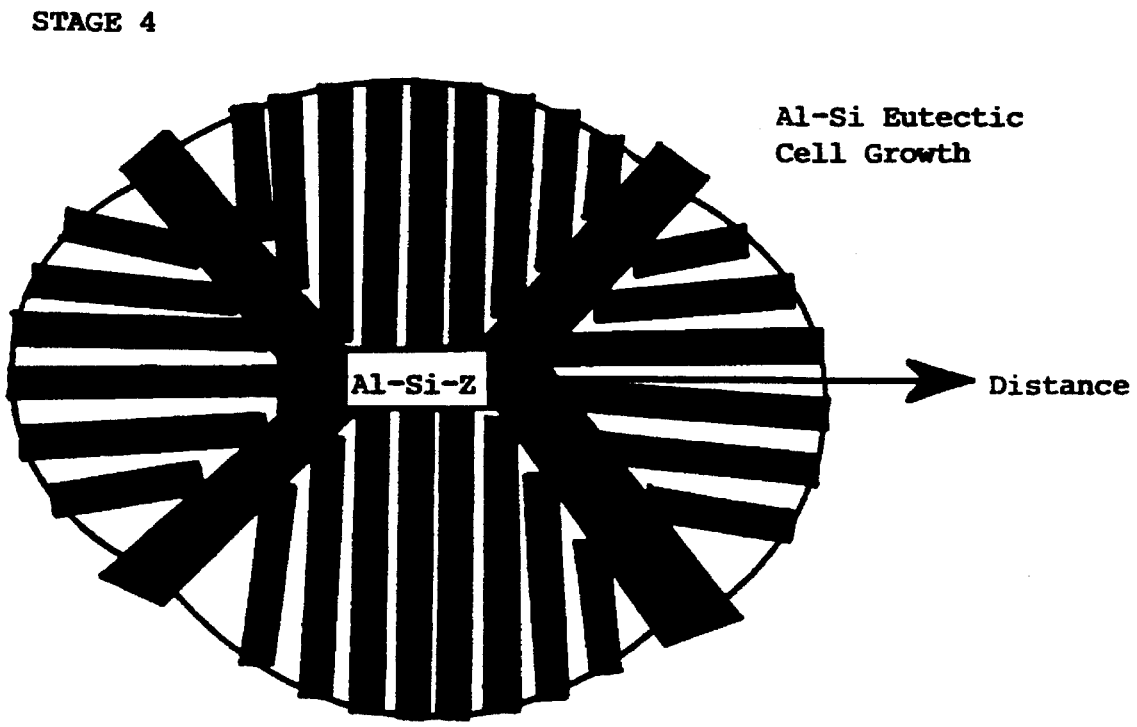
FIG. 5 is a schematic representation of the process in Stage 4 under Effect I.

FIG. 5 illustrates heterogeneous nucleation of Al-Si eutectic on the complex particles produced in Stage 3, on cooling below the eutectic solidification temperature in Stage 4.

Figure 6:
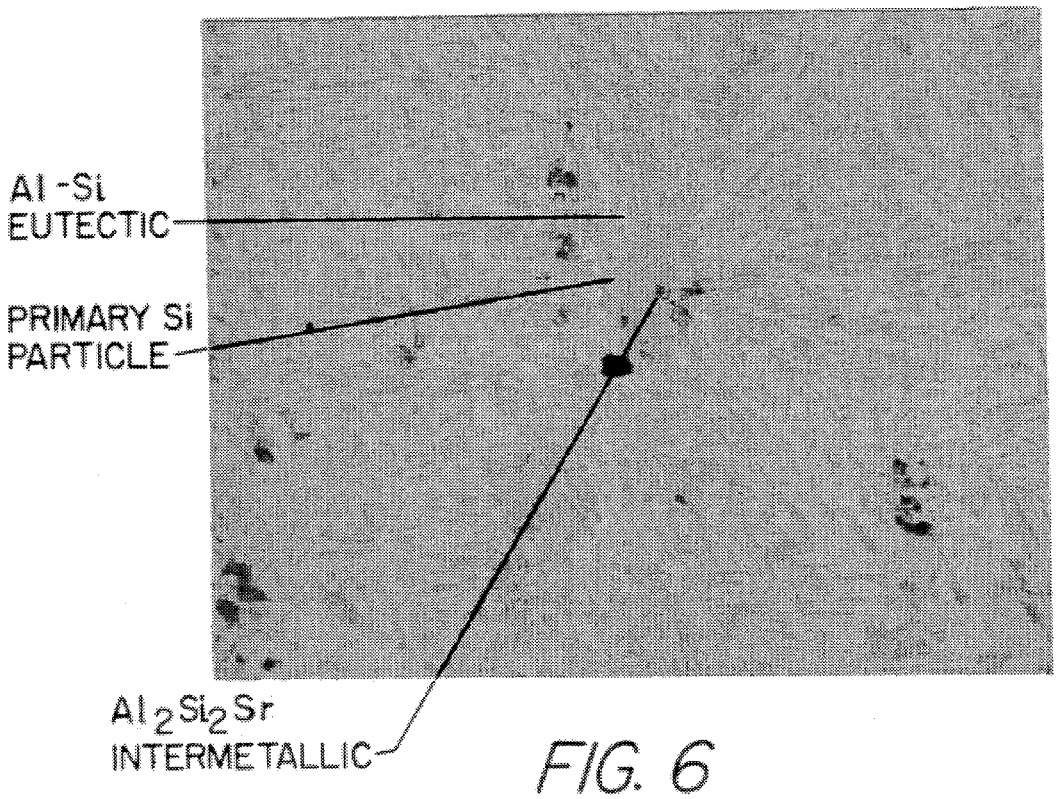
FIG. 6 is a photomicrograph illustrating Stages 3 and 4 under Effect I of the process.

The photomicrograph (X100) of FIG. 6, taken from the final casting depicted in FIG. 3, illustrates operation of the process in Stages 3 and 4. As is evident, primary Si has formed on Al-Si-Z' phase (here $Al_2Si_2Sr$), after which there has been heterogeneous nucleation of eutectic on the complex primary Si+Al-Si-Z particles.

Figure 7:
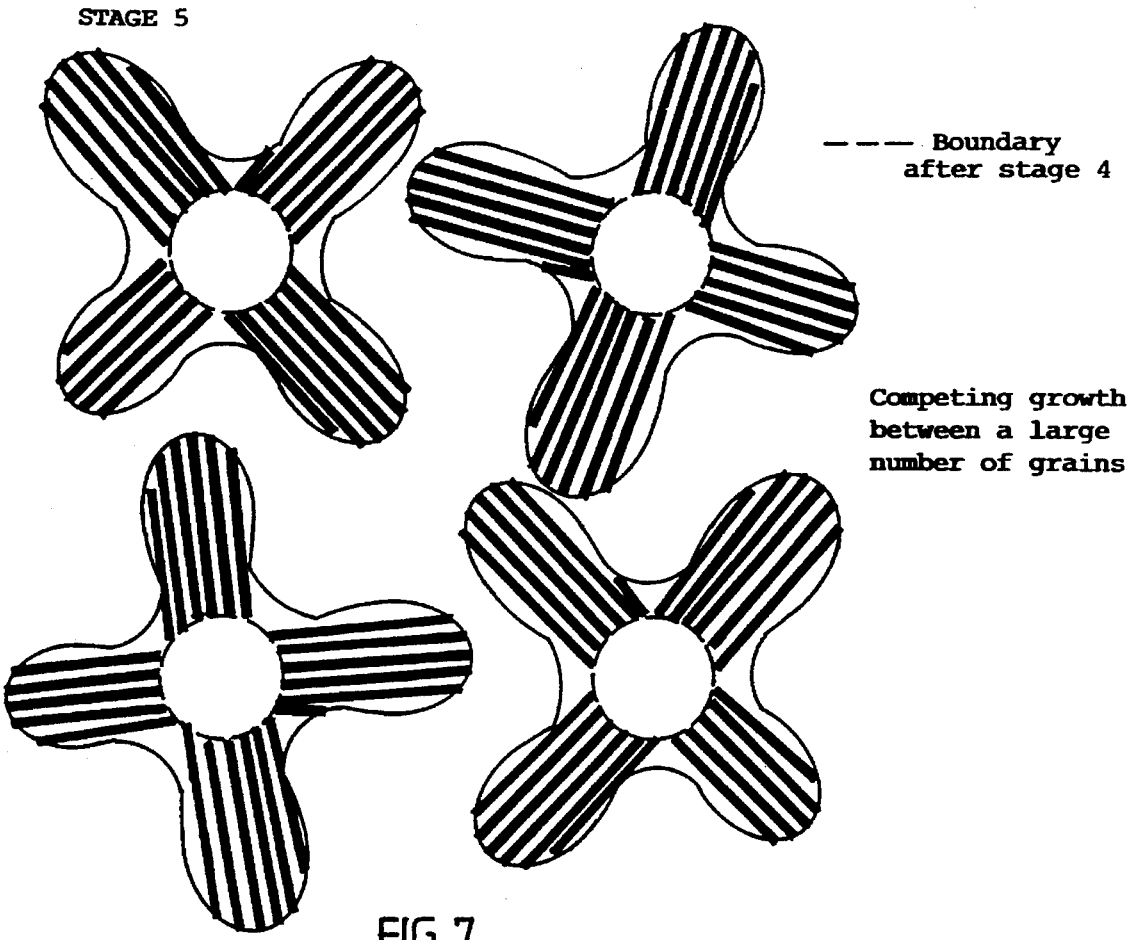
FIG. 7 is a schematic representation of solidification in the process after Stage 4 under Effect I.

As the temperature of the melt decreases further after Stage 4, multiple eutectic cells form in Stage 5 as illustrated in FIG. 7. The final cell size is controlled by the number of eutectic cells which nucleate which, in turn, is dependent on the number of nucleant particles present in Stage 1. The greater the number of eutectic cells, the greater the physical constraint on growth.

Figure 8:
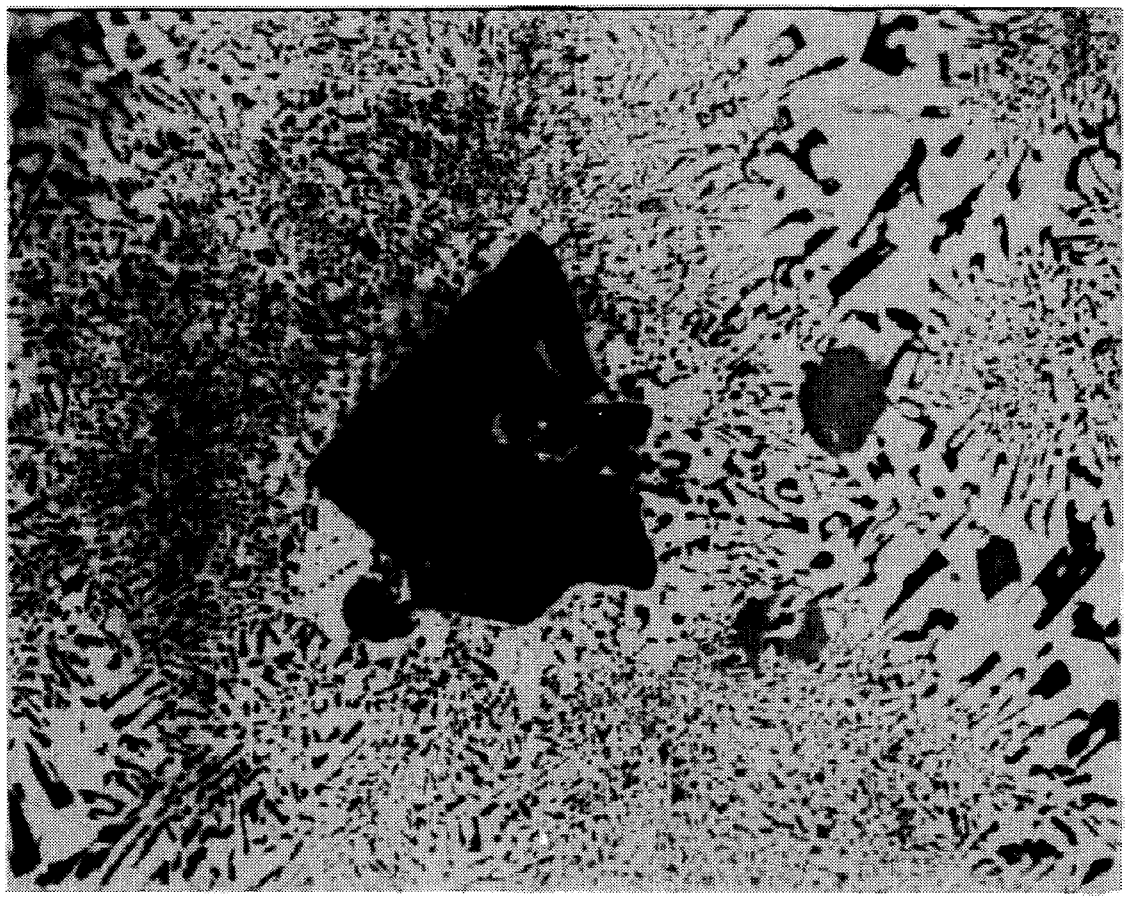
FIG. 8 is a further photomicrograph showing the structure of a casting produced in an alternative alloy according to the invention.

FIG. 8 is a photomicrograph (x200) showing the microstructure of an alloy cast according to the invention. The alloy is as used for the casting shown in FIGS. 3 and 6 except that the Sr content is less than 0.1% and the alloy contains 0.5% Cr. The photomicrograph shows a primary Si particle containing a Cr-based Al-Si-Z' intermetallic phase, believed to be $Cr_4Si_4Al_{13}$, with eutectic emanating from the complex particle.

We claim:

1. A cast hypereutectic Al-Si alloy having 12% to 15% Si, and at least one element selected from a first group of elements consisting of Cr, Mo, Nb, Ta, Ti, Zr, V and Al, at least one element selected from a second group of elements consisting of Ca, Co, Cr, Cs, Fe, K, Li, Mn, Na, Rb, Sb, Sr, Y, Ce, elements of the Lanthanide series and elements of the Actinide series, and a third group of elements, with the balance, apart from incidental impurities, being Al; the alloy having the at least one element from each of the first and second groups of elements in an amount such that the alloy has a microstructure in which any primary Si present is substantially uniformly dispersed, with the microstructure predominantly comprising a eutectic matrix; the elements of the third group comprising:

| | | | |
|---|---|---|---|
| Cu | 1.5 to 5.5% | Pb | 0 to 0.2% |
| Ni | 1.0 to 3.0% | Cr | 0 to 0.1% |
| Mg | 0.1 to 1.0% | Si modifier | 0.001 to 0.1% |
| Fe | 0.1 to 1.0% | (Na, Sr) | |
| Mn | 0.1 to 0.8% | B (elemental) | 0.05% maximum |
| Zr | 0.01 to 0.1% | Ca | 0.03% maximum |
| Zn | 0 to 3.0% | P | 0.05% maximum |
| Sn | 0 to 0.2% | Others | 0.05% maximum each, |

wherein the at least one element selected from said first group is present in the alloy as a compound providing stable nucleant particles, said compound being selected from carbide, boride, nitride, aluminide, phosphide and mixtures thereof, provided that said compound excludes Al boride; wherein the at least one element selected from the second group is present in said alloy as an intermetallic phase present as crystals thereof of which at least a proportion of said crystals have been nucleated by said stable nucleant particles; wherein said at least one element of said first group is present in an amount in excess of 0.005% up to 0.25% subject to there being not more than 0.1% Ti added as an Al-Ti-B master alloy; wherein said at least one element of said second group is present in an amount of from 0.1 to 3.0 wt %; wherein said at least one element of the first group is not solely Ti where said at least one element of the second group is solely Sr; wherein, where an element of the third group is also present in the melt as an element of said second group, the total amount of the element in the melt is in excess of the indicated upper amount of that element in said third group; wherein, where the element of said second group is Fe, it is present in an amount of at least 1.5%, where the element of the second group is Mn, it is present in an amount of at least 1%, and where the element of the second group is Sr, it is present in an amount of at least 0.11%; and wherein where said element of said first group is Zr, it is present at a level in excess of 0.1%; all percentages being by weight.

2. An alloy according to claim 1, wherein said at least one element of said second group is selected such that said intermetallic phase is of the form Al-Si-Z' or Al-Z', where Z' is at least one element of said second group.

3. An alloy according to claim 1, wherein said at least one element of said first group is present in an amount of from 0.01 to 0.25% .

4. An alloy according to claim 1, wherein said at least one element of said first group is, or includes, Ti present in an amount of from 0.01 to 0.06%.

5. An alloy according to claim 1, wherein said at least one element of said first group is, or includes, at least one of Cr, Mo, Nb, Ta, Zr, V and Al in an amount of from 0.005 to 0.2%.

6. An alloy according to claim 5, wherein the amount of said at least one element of said first group is:

| | | | |
|---|---|---|---|
| [Cu] Cr | 0.02 to 0.10% | Zr | 0.05 to 0.10% |
| Mo | 0.02 to 0.10% | V | 0.05 to 0.15% |
| Nb | 0.02 to 0.15% | Al | 0.01 to 0.15%. |
| Ta | 0.02 to 0.10% | | |

7. An alloy according to claim 1, wherein the amount of said at least one element of said second group is:

| | | | |
|---|---|---|---|
| Ca | 0.9 to 2.0% | Na | 0.1 to 0.4% |
| Co | 0.5 to 3.0% | Rb | 0.1 to 0.4% |
| Cr | 0.5 to 1.0% | Sb | 0.5 to 2.0% |
| Cs | 0.1 to 0.4% | Sr | 0.11 to 0.4% |
| Fe | 1.5 to 2.0% | Y | 0.5 to 3.0% |
| K | 0.1 to 0.4% | Ce | 0.5 to 3.0% |
| Li | 0.1 to 0.4% | Others | 0.5 to 3.0%. |
| Mn | 1.0 to 2.0% | | |

8. An alloy according to claim 7, wherein the amount of said at least one element of said second group is:

| | | | |
|---|---|---|---|
| Ca | 0.9 to 1.2% | Na | 0.2 to 0.4% |
| Co | 0.5 to 2.5% | Rb | 0.2 to 0.4% |
| Cr | 0.5 to 0.8% | Sb | 0.5 to 1.5% |
| Cs | 0.2 to 0.4% | Sr | 0.18 to 0.4% |
| Fe | 1.5 to 1.75% | Y | 0.5 to 2.5% |
| K | 0.2 to 0.4% | Ce | 0.5 to 2.5% |
| Li | 0.2 to 0.4% | Others | 0.5 to 2.5%. |
| Mn | 1.0 to 1.25% | | |

9. An alloy according to claim 3, wherein said at least one element of said first group is, or includes, Ti present in an amount of from 0.02 to 0.06%.

10. An alloy according to claim 3, wherein said at least one element of said first group is, or includes, Ti present in an amount of from 0.03 to 0.05%.

11. An alloy according to claim 1, wherein said at least one element of said first group is, or includes, at least one of Cr, Mo, Nb, Ta, Zr, V and Al in an amount from 0.01 to 0.2%.

12. A method of producing a casting of a hypereutectic Al-Si alloy having 12% to 15% Si, comprising:

(a) providing a melt suitable to form the alloy; and (b) casting the melt in a mould to form a casting of the alloy;

the melt being provided with a composition which, in addition to 12% to 15% Si, has at least one element selected from a first group of elements consisting of Cr, Mo, Nb, Ta, Ti, Zr, V and Al and at least one element selected from a second group of elements consisting of Ca, Co, Cr, Cs, Fe, K, Li, Mn, Na, Rb, Sb, Sr, Y, Ce, elements of the Lanthanide series, and elements of the Actinide series, the melt further including a third group of elements comprising:

| | | | |
|---|---|---|---|
| Cu | 1.5 to 5.5% | Pb | 0 to 0.2% |
| Ni | 1.0 to 3.0% | Cr | 0 to 0.1% |
| Mg | 0.1 to 1.0% | Si modifier | 0.001 to 0.1% |
| Fe | 0.1 to 1.0% | (Na, Sr) | |
| Mn | 0.1 to 0.8% | B (elemental) | 0.05% maximum |
| Zr | 0.01 to 0.1% | Ca | 0.03% maximum |
| Zn | 0 to 3.0% | P | 0.05% maximum |

-continued

| | | | |
|---|---|---|---|
| Sn | 0 to 0.2% | Others | 0.05% maximum each, |

the balance, apart from incidental impurities being Al; wherein the at least one element selected from the first group of elements is present in the melt as stable nucleant particles of a compound selected from carbide, boride, nitride, aluminide, phosphide and mixtures thereof, provided that said compound excludes Al boride; wherein the at least one element selected from the second group of elements forms an intermetallic phase which at least in part is nucleated, to form crystals thereof, by said stable nucleant particles, the intermetallic phase being such that crystals of said phase form in advance of and nucleate primary Si to provide complex particles which promote nucleation of Al-Si eutectic on cooling of the melt below the eutectic solidification temperature; wherein the amount of each of the at least one element of the first and second groups is such that, on solidification of the melt, the casting has a microstructure in which any primary Si present is substantially uniformly dispersed, and in which the microstructure predominantly comprises a eutectic matrix; wherein said at least one element of said first group is present in an amount in excess of 0.005% up to 0.25% subject to there being not more than 0.1% Ti added as an Al-Ti-B master alloy; wherein said at least one element of said second group is present in an amount of from 0.1 to 3.0 wt %; wherein said element of the first group is not solely Ti where said at least one element of the second group is solely Sr; wherein, where an element of the third group is also present in the melt as an element of said second group, the total amount of the element in the melt is in excess of the indicated upper amount of that element in said third group; wherein, where the element of said second group is Fe, it is present in an amount of at least 1.5%, where the element of the second group is Mn, it is present in an amount of at least 1%, where the element of the second group is Sr, it is present in an amount of at least 0.11%; and wherein where said element of the first group is Zr, it is present at a level in excess of 0.1%; all percentages being by weight.

13. A method according to claim 12, wherein said at least one element of the first group provides nucleant particles having a melting point at least 20° C. in excess of the formation temperature of said intermetallic phase.

14. A method according to claim 12, wherein said at least one element of the second group is selected such that said intermetallic phase is of the form Al-Si-Z' or Al-Z', where Z' is at least one element of said second group.

15. A method according to claim 12, wherein said at least one element of said first group is present in an amount of from 0.01 to 0.25%.

16. A method according to claim 15, wherein said at least one element of the first group is, or includes, Ti present in an amount of from 0.01 to 0.06%.

17. A method according to claim 15, wherein said at least one element of the first group is, or includes, at least one of Cr, Mo, Nb, Ta, Zr, V and Al in an amount of from 0.005 to 0.2%.

18. A method according to claim 17, wherein the amount of said at least one element of the first group is:

| | | | |
|---|---|---|---|
| Cr | 0.02 to 0.10% | Zr | 0.05 to 0.10% |
| Mo | 0.02 to 0.10% | V | 0.05 to 0.15% |

-continued

| | | | |
|---|---|---|---|
| Nb | 0.02 to 0.15% | Al | 0.01 to 0.15%. |
| Ta | 0.02 to 0.10% | | |

19. A method according to claim 12, wherein the amount of said at least one element of said second group is:

| | | | |
|---|---|---|---|
| Ca | 0.9 to 2.0% | Na | 0.1 to 0.4% |
| Co | 0.5 to 3.0% | Rb | 0.1 to 0.4% |
| Cr | 0.5 to 1.0% | Sb | 0.5 to 2.0% |
| Cs | 0.1 to 0.4% | Sr | 0.11 to 0.4% |
| Fe | 1.5 to 2.0% | Y | 0.5 to 3.0% |
| K | 0.1 tb 0.4% | Ce | 0.5 to 3.0% |
| Li | 0.1 to 0.4% | Others | 0.5 to 3.0%. |
| Mn | 1.0 to 2.0% | | |

20. A method according to claim 19, wherein the amount of said at least one element of said second group is:

| | | | |
|---|---|---|---|
| Ca | 0.9 to 1.2% | Na | 0.2 to 0.4% |
| Co | 0.5 to 2.5% | Rb | 0.2 to 0.4% |
| Cr | 0.5 to 0.8% | Sb | 0.5 to 1.5% |
| Cs | 0.2 to 0.4% | Sr | 0.18 to 0.4% |
| Fe | 1.5 to 1.75% | Y | 0.5 to 2.5% |
| K | 0.2 to 0.4% | Ce | 0.5 to 2.5% |

-continued

| | | | |
|---|---|---|---|
| Li | 0.2 to 0.4% | Others | 0.5 to 2.5%. |
| Mn | 1.0 to 1.25% | | |

21. A method according to claim 12, wherein said at least one element of the first group provides nucleant particles having a melting point substantially in excess of about 650° C.

22. A method according to claim 12, wherein said at least one element of the first group provides nucleant particles having a melting point in excess of 700° C.

23. A method according to claim 12, wherein said at least one element of the first group is added as a master alloy composition.

24. A method according to claim 15, wherein said at least one element of the first group is, or includes, Ti present in an amount of 0.02 to 0.06%.

25. A method according to claim 15, wherein said at least one element of the first group is, or includes, Ti present in an amount of 0.03 to 0.05%

26. A method according to claim 12, wherein said at least one element of the first group is, or includes, at least one of Cr, Mo, Nb, Ta, Zr, V and Al in an amount of from 0.01 to 0.2%.

* * * * *

UNITED STATES PATENT AND TRADEMARK OFFICE

CERTIFICATE OF CORRECTION

PATENT NO. : 5,484,492

DATED : January 16, 1996

INVENTOR(S) : ROGERS et al.

It is certified that error appears in the above-indentified patent and that said Letters Patent is hereby corrected as shown below:

Title page. Rewrite item "[63]" to read as follows:

-- Related U.S. Application Data

[63] Continuation of Ser. No. 852,178, filed April 3, 1992, abandoned, which was the national stage of international application number PCT/AU90/00341, filed August 9, 1990.--.

Signed and Sealed this

Eleventh Day of June, 1996

*Attest:*

Bruce Lehman

BRUCE LEHMAN

*Attesting Officer*

*Commissioner of Patents and Trademarks*